US006286941B1

(12) United States Patent
Courian et al.

(10) Patent No.: US 6,286,941 B1
(45) Date of Patent: Sep. 11, 2001

(54) PARTICLE TOLERANT PRINTHEAD

(75) Inventors: Kenneth J. Courian; Thomas M. Sabo; Joe R. Pietrzyk; Stephen W. Bauer, all of San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/179,362

(22) Filed: Oct. 26, 1998

(51) Int. Cl.[7] ..... B41J 2/05; B41J 2/17
(52) U.S. Cl. ..... 347/65; 347/94
(58) Field of Search ..... 347/63, 65, 94, 347/67

(56) References Cited

U.S. PATENT DOCUMENTS

| | | | | |
|---|---|---|---|---|
| 5,278,584 | | 1/1994 | Keefe et al. | 347/65 |
| 5,638,101 | * | 6/1997 | Keefe et al. | 347/65 |
| 5,675,367 | | 10/1997 | Scheffelin et al. | 347/86 |
| 5,793,393 | | 8/1998 | Coven | 347/65 |

FOREIGN PATENT DOCUMENTS

| | | | | |
|---|---|---|---|---|
| 0659561 A2 | * | 12/1994 | (EP) | B41J/2/05 |
| 0 659 561 A2 | | 6/1995 | (EP) . | |

* cited by examiner

*Primary Examiner*—John Barlow
*Assistant Examiner*—Juanita Stephens

(57) ABSTRACT

An inkjet print cartridge uses at least one groove to supply ink from an ink reservoir to the fluid channel, which includes an ink ejection chamber, such that foreign particles within the ink supply are filtered out by the grooves so as not to block the fluid channel. In one embodiment, a barrier layer between a substrate and nozzle member contains the ink ejection chamber which is in communication with a plenum via a flow restrictor, such as pinch points. The nozzle member includes an array of orifices and grooves. The substrate includes two linear arrays of ink ejection elements, such as heater elements, and each orifice in the nozzle member is associated with an ink ejection chamber and ink ejection element. A plurality of grooves is likewise associated with each plenum. The plurality of grooves in the nozzle member supply ink into each plenum, which in turn supplies ink to the ink ejection chamber.

34 Claims, 11 Drawing Sheets

PARTICLE TOLERANT PRINTHEAD

FIELD OF THE INVENTION

This invention relates to inkjet and other type of printers and, more particularly, to the printhead portion of an ink cartridge used in an inkjet printer.

BACKGROUND

Thermal inkjet print cartridges operate by rapidly heating a small volume of ink to cause the ink to vaporize and be ejected through one of a plurality of orifices so as to print a dot of ink on a recording medium, such as a sheet of paper. Typically, the orifices are arranged in one or more linear arrays in a nozzle member. The properly sequenced ejection of ink from each orifice causes characters and other images to be printed upon the paper as the printhead is moved relative to the paper. The paper is typically shifted each time the printhead has moved across the paper. The thermal inkjet printer is fast and quiet, as only the ink strikes the paper. These printers produce high quality printing and can be made both compact and affordable.

In one prior art design, the inkjet printhead generally includes: (1) ink channels to supply ink from an ink reservoir to each vaporization chamber proximate to an orifice; (2) an orifice plate or nozzle member in which the orifices are formed in the required pattern; and (3) a silicon substrate containing a series of thin film resistors, one resistor per vaporization chamber.

To print a single dot of ink, an electrical current from an external power supply is passed through a selected thin film resistor. The resistor is then heated, in turn superheating a thin layer of the adjacent ink within a vaporization chamber, causing explosive vaporization, and, consequently, causing a droplet of ink to be ejected through an associated orifice in the nozzle member and onto the paper.

Two patents that describe examples of printhead portions of an inkjet printhead that may be improved by the present invention are U.S. Pat. No. 5,638,101 entitled High Density Nozzle Array for Inkjet Printhead, by Brian Keefe et al., and U.S. Pat. No. 5,278,584, entitled "Ink Delivery System for an Inkjet Printhead," by Brian Keefe et al., which are assigned to the present assignee and incorporated herein by reference. In U.S. Pat. No. 5,278,584, ink is fed from an ink reservoir to each vaporization chamber through an ink channel formed in a barrier layer between the substrate and the nozzle member. The ink channels in the barrier layer generally have ink entrances running along two opposite edges of the substrate so that ink flowing around the edges of the substrate gain access to the ink channels and to the vaporization chambers. A disadvantage of this type of prior art inkjet printhead design is that internal contaminants may plug the ink flow path in the printhead. Consequently, the flow of ink may become restricted or shut off entirely thereby preventing the droplet of ink from being ejected onto the paper. Further, the energization of a heater element in one vaporization chamber may affect the flow of ink into a nearby vaporization chamber, thus producing cross-talk. Cross-talk affects the amount of ink emitted by an orifice upon energization of an associated element.

One method of keeping particles from plugging the ink flow path is to build a very clean inkjet print cartridge, i.e., an inkjet print cartridge with no foreign particles. However, eliminating small particles produced in the manufacture of an inkjet print cartridge is difficult and expensive. Another particle tolerant configuration uses multiple inlet channels into each vaporization chamber. Thus, when one inlet channel is plugged by a foreign particle, ink can still flow into the vaporization channel through other inlet channels. However, the performance of the multiple channel configuration changes when one channel is plugged, thereby degrading the print quality of the inkjet printhead.

Another particle tolerant configuration is described in U.S. Pat. No. 5,638,101, which uses enlarged areas or "barrier reefs" formed near the entrance of each ink channel to constrict the entrance of the ink channels to help filter large foreign particles. In addition, relatively narrow constriction points, known as pinch points, are included in the ink channels to provide damping during refill of the vaporization chambers after firing to help reduce cross-talk. However, barrier reefs can be knocked off during processing thus becoming useless, or worse, becoming a contaminant themselves. Further, using pinch points and barrier reefs within the ink channels lengthens the ink channel, which requires an increase in the substrate area.

Consequently, what is needed is a particle tolerant printhead architecture for an inkjet print cartridge.

SUMMARY

An inkjet print cartridge in accordance with an embodiment of the present invention uses at least one groove to supply ink from an ink reservoir to the fluid channel, which includes the vaporization chamber, such that foreign particles within the ink supply are filtered out by at least one groove so as not to block the fluid channel. A barrier layer between a substrate and nozzle member contains the fluid channel, which includes a vaporization chamber in communication with a plenum via a flow restrictor, such as pinch points. Multiple vaporization chambers may be connected to a single plenum or there may be a separate plenum associated with each vaporization chamber. The nozzle member includes an array of orifices and at least one groove. If desired, multiple grooves, e.g., four, may be associated with each plenum. In an alternative embodiment, the grooves are disposed within the barrier layer. The substrate includes two linear arrays of heater elements, and each orifice in the nozzle member is associated with a vaporization chamber and heater element. The plurality of grooves are the sole supply of ink into each plenum. Thus, the ink flows through a plurality of grooves and into a plenum, which in turn supplies ink to the vaporization chamber via the flow restrictor.

Because the ink is not permitted to flow directly from the ink reservoir to the plenum or vaporization chamber, but must first flow through the plurality of grooves, any foreign particle that is greater than the width of a groove will be filtered so that it may not enter the fluid channel. In addition, because the width of the grooves is less than the width of the fluid channel, in particular the fluid restrictor and the orifice, any particle that does flow through a groove will be expelled without blocking the fluid channel path.

Additionally, each fluid channel, i.e., vaporization chamber and plenum, is in fluid communication with the ink reservoir solely through the associated plurality of grooves. Consequently, each fluid channel is isolated from other fluid channels thereby virtually eliminating cross talk. Moreover, by separating the plenum from the ink reservoir by a segment of the barrier layer, there is additional material to which the nozzle member may be affixed. Thus, problems with delamination or dimpling of the nozzle member can be reduced.

Other advantages will become apparent after reading the disclosure.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DETAILED DESCRIPTION

Figure 1:
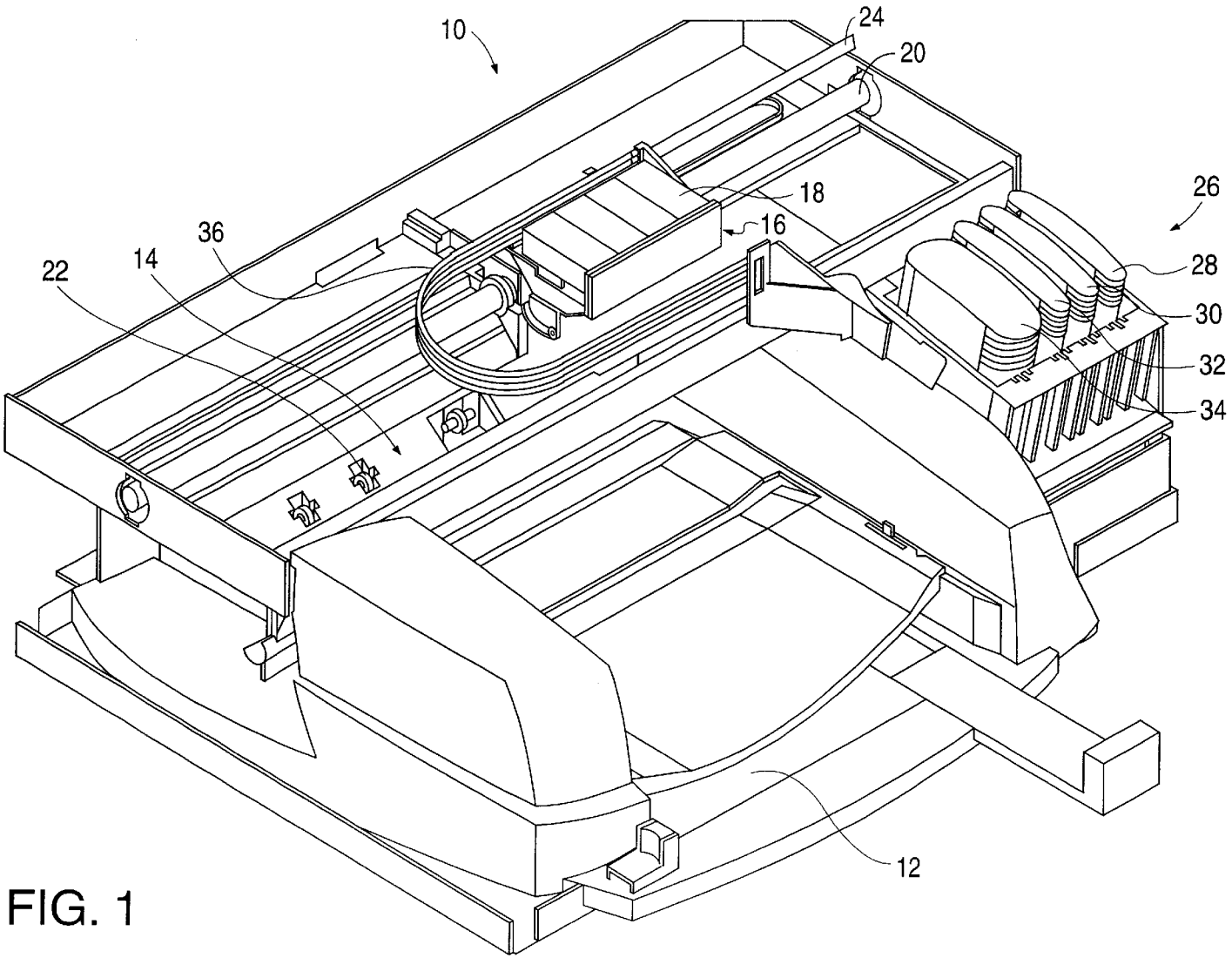
FIG. 1 is a simplified example of an inkjet printer with a top cover removed.

FIG. 1 is a simplified example of an inkjet printer 10 with a top cover removed. Inkjet printer 10 includes an input tray 12 for holding sheets of paper. When printing operations are initiated, paper is fed from input tray 12 and passed through a print zone 14 for being printed upon. The paper stopped as it passes through print zone 14 and a movable carriage 16, containing one or more inkjet print cartridges 18, is then scanned across the sheet of paper to print a swath of ink thereon. The carriage 16 is moved along a scan axis by a conventional belt and pulley system and slides along a slide rod 20. Print cartridge 18 conventionally holds yellow, magenta, cyan, or black ink. Where multiple print cartridges are used in carriage 18, different colors of ink may be used.

After a single scan or multiple scans of carriage 16, the sheet of paper is incrementally shifted using a conventional stepper motor and feed rollers 22 to a next position within print zone 14, and carriage 16 again scans across the sheet of paper to print another swath of ink thereon.

Printing signals from an external computer are processed by printer 10 to generate a bit map of the dots to be printed. The bit map is then converted into firing signals for the printhead. The position of the carriage 16 as it traverses back and forth along the scan axis is determined from an optical encoder strip 24, detected by a photoelectric element on carriage 16, to cause the various ink ejection elements on each print cartridge to be selectively fired at the appropriate time during a carriage scan.

Printer 10 may include an off carriage ink supply station 26 that contains replaceable ink supply cartridges 28, 30, 32, and 34, which are connected to the print cartridges of carriage 16 via flexible ink tubes 36. Printer 10 may alternatively include an on carriage ink supply station for replaceable ink supply cartridges that are connected the print cartridges 18. Of course, the ink supply may also be a non-replaceble ink supply that is integral to print cartridges 18.

Figure 2:
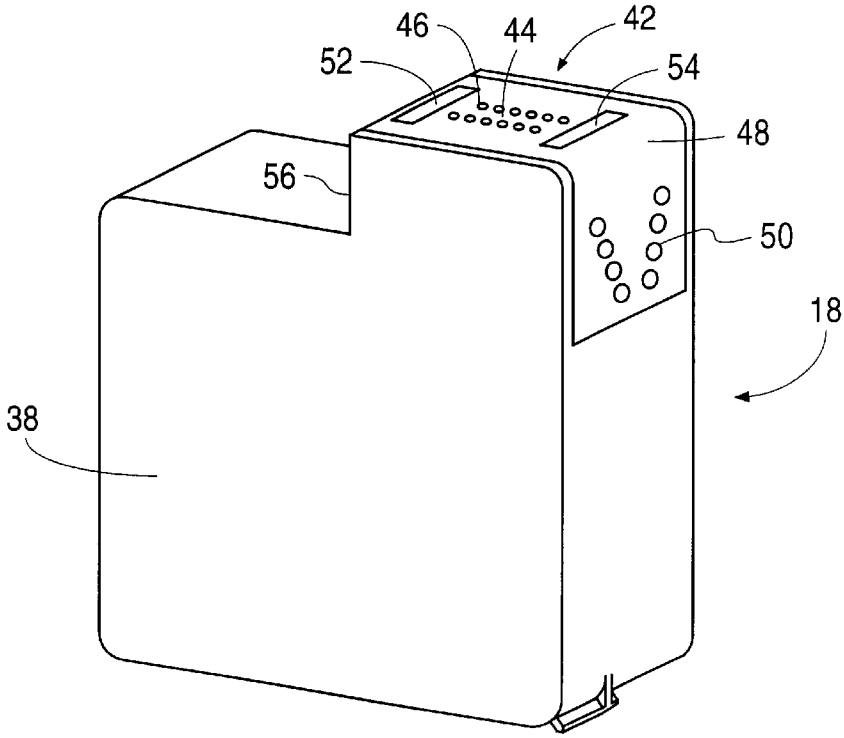
FIG. 2 illustrates an inkjet print cartridge incorporating a printhead according to one embodiment of the present invention.

FIG. 2 illustrates an inkjet print cartridge 18 incorporating a printhead according to one embodiment of the present invention. Print cartridge may be used in printer 10 in FIG. 1 or in a similar type inkjet printer, including a large format plotter, or a dedicated printer, such as a postal printing device. Print cartridge 18 includes an ink reservoir 38 and a printhead 42, which is formed using Tape Automated Bonding (TAB). Printhead 42 includes a nozzle member 44 comprising two parallel columns of offset holes or orifices 46 formed in a flexible polymer tape 48 by, for example, laser ablation. Nozzle member 44 also comprises a plurality of grooves associated with each orifice 46. The plurality of grooves will be discussed further below in reference to FIGS. 7, 8, and 9. Tape 48 may be purchased commercially as Kapton TM tape, available from 3M Corporation. Other suitable tape may be formed of Upilex TM or its equivalent.

While print cartridge 18, as shown in FIG. 2, includes an ink reservoir 38 that is part of print cartridge 18, it should be understood that the supply of ink may also be in the form of an external replaceable ink supply that is detachably connected to the printhead 42 of print cartridge 18. The ink supply can thus be separate from print cartridge 18 and may be on the carriage 16 shown in FIG. 1 or may be off the carriage 16 and connected to print cartridge 18 via a flexible tube 36. The replaceable ink supply may be directly connected to the printhead 42 or alternatively, the replaceable ink supply may be connected to the printhead 42 via intermediate elements, such as ink reservoir 38 in the print cartridge 18.

A back surface of the tape 48 includes conductive traces 66 (shown in FIG. 4) formed thereon using a conventional lithographic etching and/or plating process. These conductive traces are terminated by large contact pads 50 designed to electrically contact electrodes in cartridge 16 of printer 10 for receiving power and ground signals as well as the firing signals for the printhead 42.

Windows 52 and 54 extend through the tape 48 and are used to facilitate bonding of the other ends of the conductive traces to electrodes on a silicon substrate containing heater resistors. The windows 52 and 54 are filled with an encapsulant to protect any underlying portion of the traces and substrate.

As shown in FIG. 2, the tape 48 is bent over the back edge of the print cartridge "snout" and extends approximately one half the length of the back wall 56 of the snout. This flap portion of the tape 48 is used for routing of conductive traces, which are connected to the substrate electrodes through the far end window 52.

Figure 3:
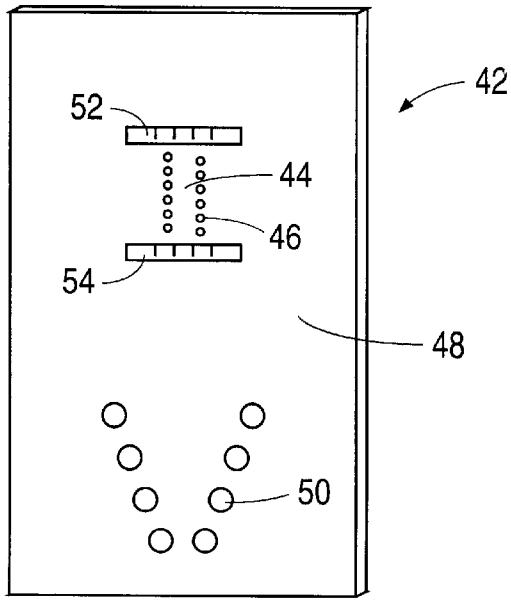
FIG. 3 shows a front view of the printhead of FIG. 2 removed from the print cartridge.

FIG. 3 shows a front view of printhead 42 of FIG. 2 removed from the print cartridge 18 and prior to windows 52 and 54 in printhead 42 being filled with an encapsulant.

Affixed to the back of printhead 42 is a silicon substrate 60 (shown in FIG. 4) containing a plurality of individually energizable thin film resistors. Each resistor is located generally behind a single orifice 46 and acts as an ohmic heater when selectively energized by one or more pulses applied sequentially or simultaneously to one or more of the contact pads 50. Alternatively, piezoelectric elements may be used behind each orifice in place of a resistor.

The orifices 46 and conductive traces may be of any size, number, and pattern, and the various figures are designed to clearly show the features of the present invention. It should be understood that the relative dimensions of the various features have been greatly adjusted for the sake of clarity.

Figure 4:
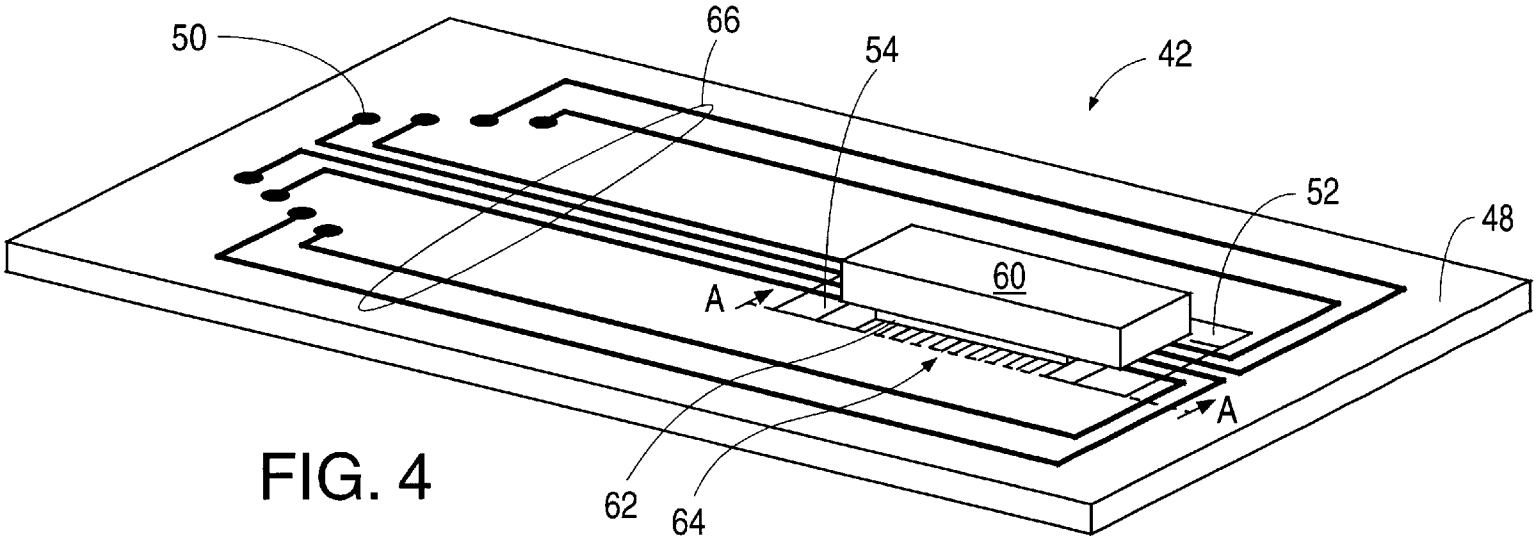
FIG. 4 shows a back surface of the printhead of FIG. 3 illustrating the silicon substrate mounted on the back of the tape and also showing one edge of a barrier layer formed on the substrate.
Figure 6:
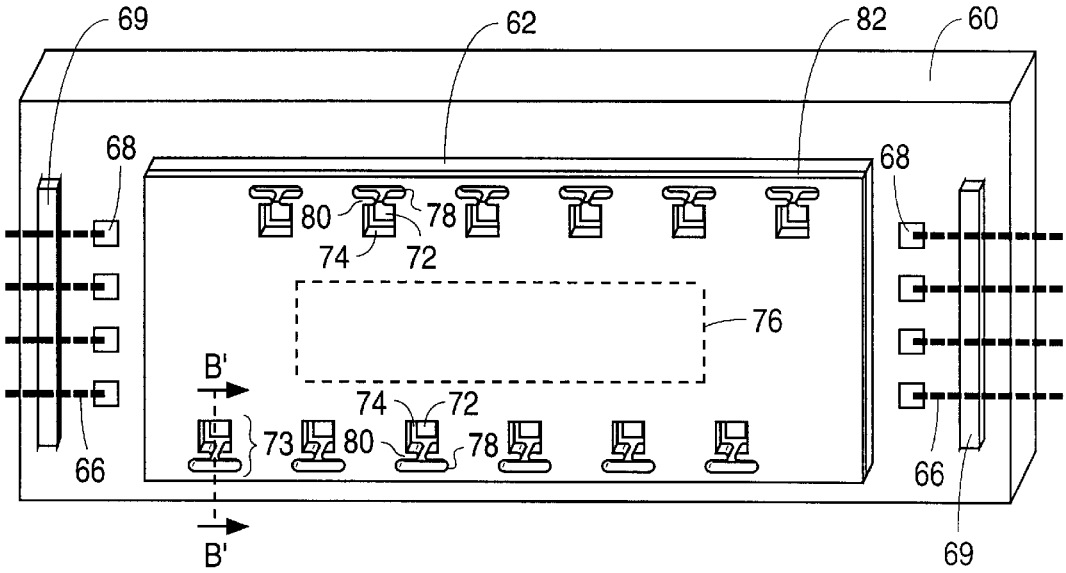
FIG. 6 is a front perspective view of the silicon substrate, which is affixed to the back of the tape in FIG. 4 to form the printhead.

FIG. 4 shows a back surface of printhead 42 of FIG. 3 illustrating the silicon substrate 60 mounted on the back of the tape 48 and also showing one edge of a barrier layer 62 formed on the substrate 60. As shown in FIG. 4, the edge of barrier layer 62 is solid. While fluid channels are present in barrier layer 62, the fluid channels can not be seen in the view shown in FIG. 4. FIG. 6 shows greater detail of barrier layer 62, including the fluid channels, and will be discussed later. Shown along tape 48 adjacent barrier layer 62 are a plurality of grooves 64, which are used to supply ink from the ink reservoir 38 (shown in FIG. 2) to the fluid channels within barrier 62.

The conductive traces 66 formed on the back of the tape 48 are also shown in FIG. 4 where the traces 66 terminate in contact pads 50 (FIG. 3) on the opposite side of the tape 48.

The windows 52 and 54 allow access to the ends of the traces 66 and the substrate electrodes from the other side of the tape 48 to facilitate bonding.

Figure 5:
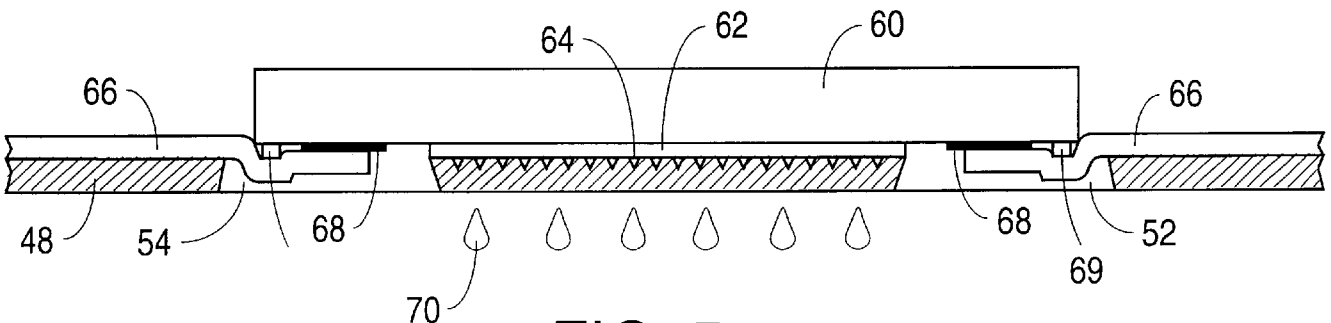
FIG. 5 shows a side view cross-section taken along line A—A in FIG. 4 illustrating the connection of the ends of the conductive traces to the electrodes formed on the substrate.

FIG. 5 shows a side view cross-section taken along line A—A in FIG. 4 illustrating the connection of the ends of the conductive traces 66 to the electrodes 68 formed on the substrate 60. As seen in FIG. 5, a portion 69 of barrier layer 62 is used to insulate the ends of the conductive traces 66 from the substrate 60.

Also shown in FIG. 5 is a side view of the tape 48, the grooves 64 within the tape 48, the barrier layer 62, and the windows 52 and 54. Droplets 70 of ink are shown being ejected from orifice holes associated with the heater resistors shown in FIG. 6.

FIG. 6 is a front perspective view of the silicon substrate 60, which is affixed to the back of the tape 48 in FIG. 4 to form printhead 42. Silicon substrate 60 has formed on it, using conventional lithographic techniques, two rows of ink ejection elements, such as thin film resistors 72 or piezoelectric elements, shown in FIG. 6 exposed through the ink ejection chambers 74 formed in barrier layer 62. Where the ink ejection elements used are heater resistors, the ink is vaporized within ink ejection chamber 74, and thus, ink ejection chamber 74 is a vaporization chamber 74. Chamber 74 will be referred to as a vaporization chamber 74 for the sake of simplicity. In one embodiment, the substrate 60 is approximately one-half inch long and contains 300 heater resistors 72, thus enabling a resolution of 600 dots per inch.

Also formed on the substrate 60 are electrodes 68 for connection to the conductive traces 66 (shown by dashed lines) formed on the back of the tape 48 in FIG. 4.

A demultiplexer 76, shown by a dashed outline in FIG. 6, is also formed on the substrate 60 for demultiplexing the incoming multiplexed signals applied to the electrodes 68 and distributing the signals to the various thin film resistors 72. The demultiplexer 76 enables the use of fewer electrodes 68 than thin film resistors 72. Having fewer electrodes allows all connections to the substrate to be made from the short end portions of the substrate, as shown in FIG. 5, so that these connections will not interfere with the ink flow around the long sides of the substrate. The demultiplexer 76 may be any decoder for decoding encoded signals applied to the electrodes 68. The demultiplexer has input leads (not shown for simplicity) connected to the electrodes 68 and has output leads (not shown) connected to the various resistors 72. It should be understood that other methods of distributing firing signals to the various thin film resistors 72 are possible, including direct drive and digital signal encoding, which will obviate the need for demultiplexer 76.

Also formed on the surface of the substrate 60 using conventional lithographic techniques is the barrier layer 62, which may be a layer of photoresist or some other polymer, in which is formed a fluid channel including the vaporization chambers 74 and plenums 78. Plenums 78 enclose a space into which ink is supplied via the grooves 64 that are ablated into the tape 48, shown in FIG. 4. As illustrated in FIG. 6, a barrier exists between the plenums 78 and the edge of the barrier layer 62. A flow restrictor in the form of pinch points 80 separates the plenums 78 from the vaporization chambers 74.

A portion 69 of the barrier layer 62 insulates the conductive traces 66 from the underlying substrate 60, as previously discussed with respect to FIG. 5.

To adhesively affix the top surface of the barrier layer 62 to the back surface of the tape 48 shown in FIG. 4, a thin adhesive layer 82, such as an uncured layer of poly-isoprene photoresist, is applied to the top surface of barrier layer 62. Of course, the separate adhesive layer 30 is not necessary if the top surface of the barrier layer 62 and the back surface of tape 48 can be otherwise made to adhere to each other. For the sake of simplicity, the present description will assume that adhesive layer 82 is used to adhere barrier layer 62 to tape 48 unless otherwise indicated. The resulting substrate structure is then positioned with respect to the back surface of the tape 48 so as to align the resistors 72 with the orifices formed in the tape 48. This alignment step also inherently aligns the electrodes 68 with the ends of the conductive traces 66. The traces 66 are then bonded to the electrodes 68. This alignment and bonding process is described in more detail later with respect to FIG. 23. The aligned and bonded substrate/tape structure is then heated while applying pressure to cure the adhesive layer 82 and firmly affix the substrate structure to the back surface of the tape 48.

Figure 7:
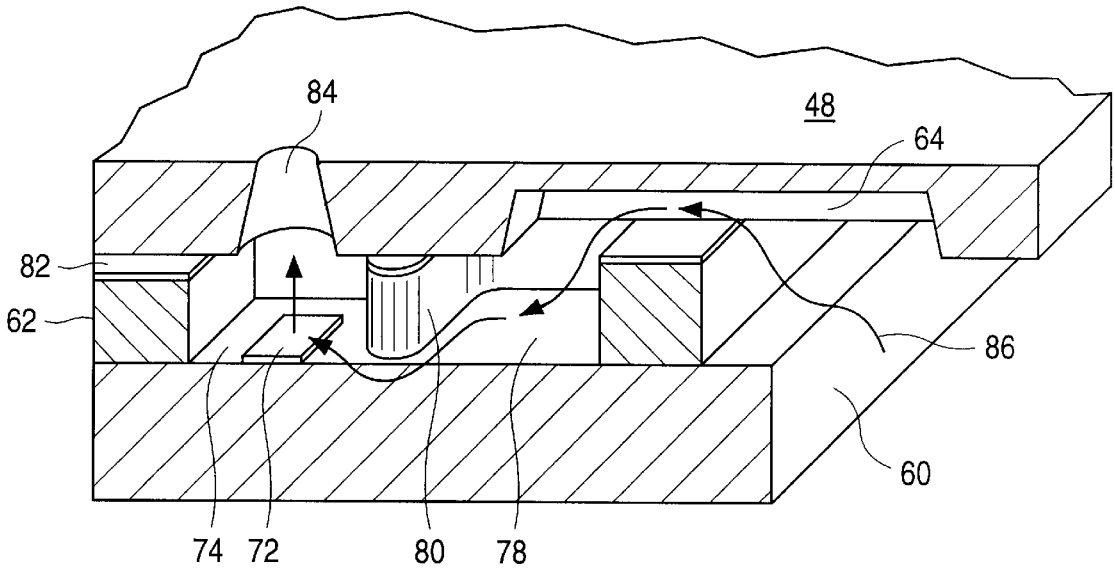
FIG. 7 is an enlarged cross-sectional view of the substrate and barrier layer taken along line B—B in FIG. 6.

FIG. 7 is an enlarged view of a single vaporization chamber 74, thin film resistor 72, a single groove 64, and a frustum shaped orifice 84 after the substrate structure of FIG. 6 is secured to the back of the tape 48 via the thin adhesive layer 82. FIG. 7 shows a cross-section of substrate 60 and barrier layer 62 taken along line B—B in FIG. 6. Also shown in FIG. 7 is plenum 78 and one-half of a pinch point 80. In operation, ink flows from the ink reservoir 38 in FIG. 2, around the edge of substrate 60 and around barrier layer 62 through groove 64, and into the fluid channel comprised of plenum 78, past pinch point 80 and vaporization chamber 74, as shown by arrows 86. Upon energization of the thin film resistor 72, a thin layer of adjacent ink is superheated, causing explosive vaporization and, consequently, causing a droplet of ink to be ejected through the orifice 84. The vaporization chamber 74 is then refilled by capillary action.

In one embodiment, the barrier layer 62, if used, is approximately 0.75 to 1 mil thick, the substrate 60 is approximately 20 mils thick, and the tape 48 is approximately 2 mils thick.

Figure 8:
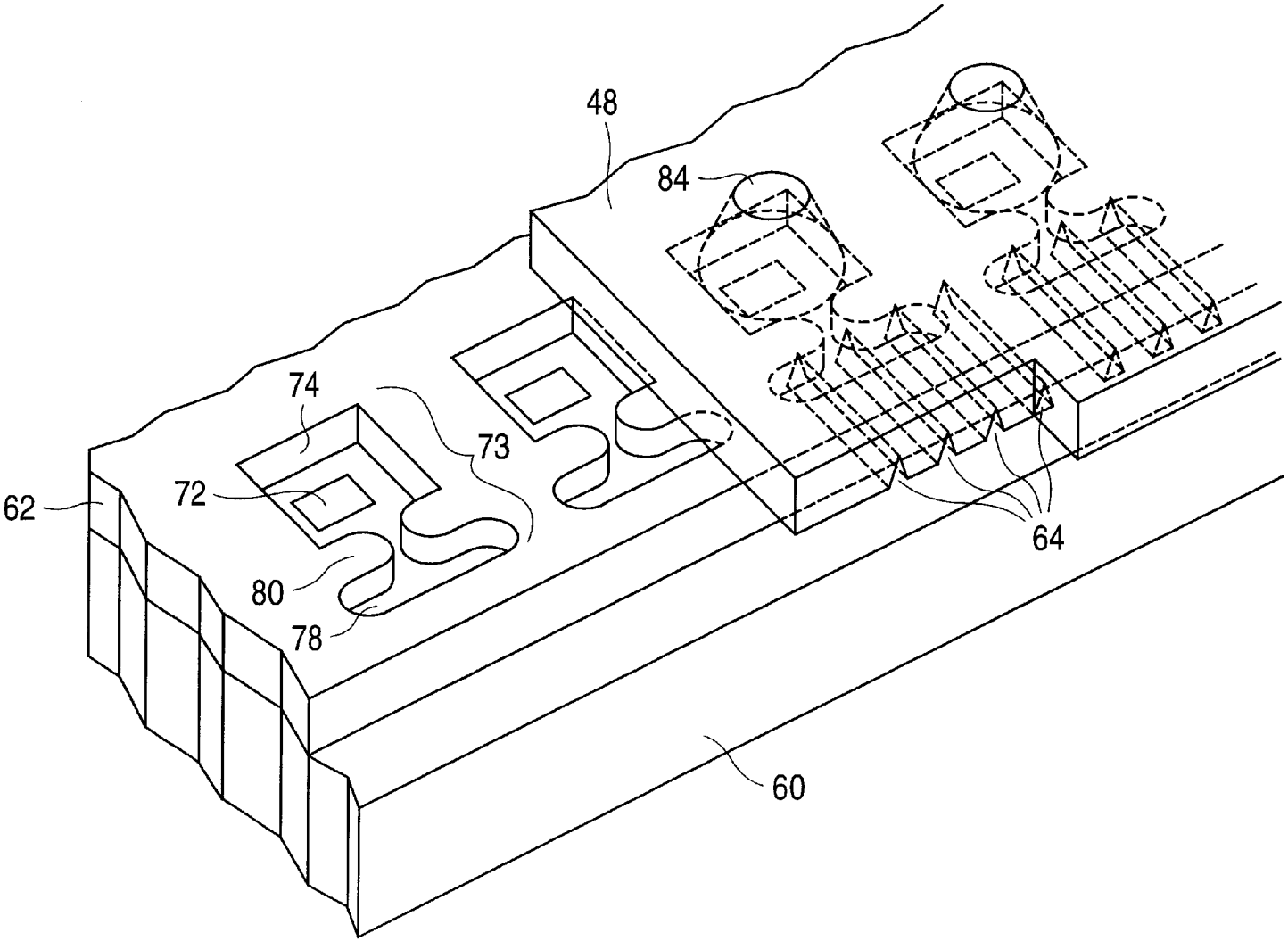
FIG. 8 shows a top perspective view of the tape overlying the barrier layer and silicon substrate.

FIG. 8 shows a top perspective view of tape 48 overlying the barrier layer 62 and silicon substrate 60. Within barrier layer 62 is shown several plenums 78 and associated vaporization chambers 74 through which thin film resistors 72 can be seen. Tape 48 includes frustum shaped orifices 84 and a plurality of grooves 64, indicated with dotted lines because they lie on the bottom side of tape 48 in this view. Parts of tape 48 are shown cut away in FIG. 8 so as to clearly show the structures within barrier layer 62 and parts of the groove 64 structure.

As shown in FIG. 8, a plurality of grooves 64 within tape 48 overlie the plenum 78 structure within barrier layer 62. Because the ink is supplied to plenums 78 through grooves 64, multiple grooves 64 are used to assure that an adequate supply of unrestricted ink flow is available. Grooves 64, however, are narrow so as to act as a sieve to advantageously prevent foreign particles from entering plenum 78 or vaporization chamber 74. The flow resistance into the plenum 78 is much less than the resistance provided by the pinch point 80, which acts as a flow resistance feature.

Figure 9:
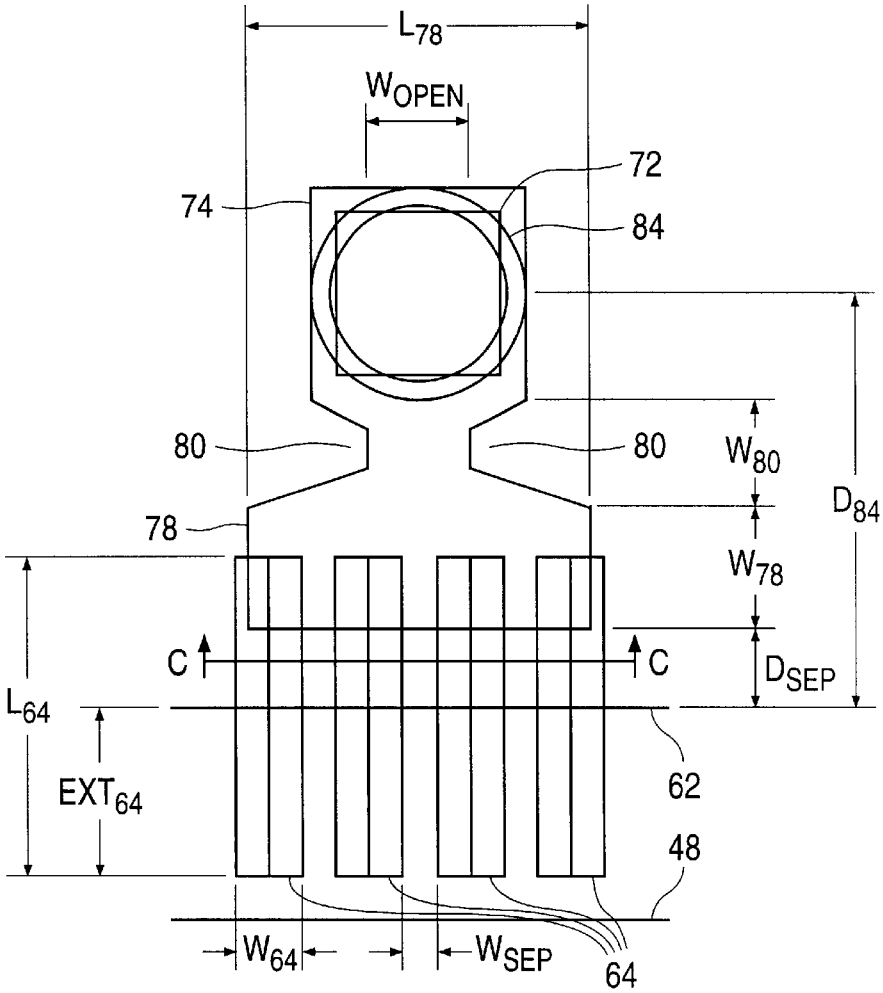
FIG. 9 is a top down plan view showing a thin film resistor surrounded by a vaporization chamber in communication with an associated plenum via pinch points, as well as an orifice and associated plurality of grooves.

FIG. 9 is a top down plan view showing the edge of tape 48 and the edge of barrier layer 62, where tape 48 is overlying barrier layer 62. FIG. 9 also shows vaporization chamber 74 and associated plenum 78, pinch points 80, and thin film resistor 72 illustrated in solid lines for clarity even though they lie under tape 48. Within tape 48 are orifice 84 and a plurality of grooves 64, which are also shown in solid lines for clarity even though they lie on the bottom side of tape 48.

Figure 10:
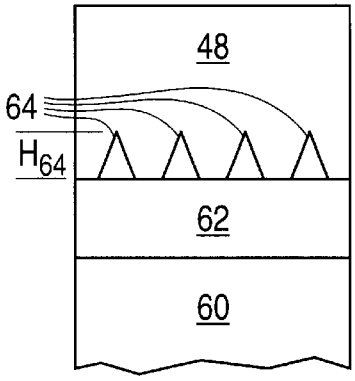
FIG. 10 is a side elevational view cross-section taken along line C—C in FIG. 9 showing the tape, the barrier layer, and a portion of substrate.

While FIG. 9 shows four grooves 64 extending over plenum 78, it should be understood that this number is illustrative, and that a different number, e.g., three to five, may be used. The particular number of grooves 64 used with each individual plenum 78 is dependent on the volume of ink that the grooves are able to supply. Grooves 64 should supply a volume of ink to plenum 78 adequate to produce a refill rate of approximately 10 kHz to 15 kHz, nominally 12 kHz. It should be understood that as technology permits an increase in the firing rate, the volume of ink that must be supplied by grooves 64 should be increased correspondingly. The volume of ink that may be supplied by grooves 64 is of course dependent on the geometry of grooves 64. Grooves 64 are laser ablated into tape 48 and have a triangular cross-section with a maximum width $W_{64}$ of approximately 10 $\mu$m to 20 $\mu$m, nominally 15 $\mu$m, and a height of 25 $\mu$m to 45 $\mu$m, nominally 45 $\mu$m, as shown in FIG. 10, discussed below. If desired, grooves 64 may have a different cross-section, such as rectangular, which is dependent on the particular ablation process used, as will be discussed in more detail below. Grooves 64 are separated from one another by a width $W_{SEP}$ approximately equal to 1.5 $\mu$m. The length $L_{64}$ of grooves 64 is approximately 100 $\mu$m, but may vary. Grooves 64 should extend into the ink reservoir 38, shown in FIG. 2, by an amount, $EXT_{64}$, adequate to permit unrestricted flow of the ink into the grooves 64, approximately 40 $\mu$m, but of course this may drastically change as long as ink can flow into grooves 64 in an unrestricted manner. Grooves 64 should extend over plenum 78 by an amount that permits an unrestricted flow of the ink out of grooves 64. Thus, ideally, grooves 64 should extend as far over plenum 78 as possible. Grooves 64 should not, however, by-pass pinch points 80 and extend into vaporization chamber 74 or the flow control of the pinch points 80 will be lost.

Of course, if desired a larger number of smaller dimensioned (width and height) grooves 64 may be used to improve the particle exclusion performance of grooves 64. Grooves 64, however, must be able to supply a volume of ink that is adequate to refill the plenum 78 at the desired rate. Nevertheless, because the dimensions of the down stream features, i.e., pinch points 80, vaporization chamber 74 and orifice 84, are greater than the dimensions of the widest part of grooves 64, any particle that is small enough to pass through a groove will not cause an obstruction within the down stream printhead architecture.

The edge of plenum 78 is separated from the edge of barrier layer 62 by a distance $D_{SEP}$ of approximately 20 $\mu$m. Plenum 78 has a width $W_{78}$ of approximately 20–40 $\mu$m, nominally 27.5 $\mu$m, and a length $L_{78}$ of approximately 65 $\mu$m. Of course, the exact dimensions may vary as long as plenum 78 holds a volume of ink sufficient to supply an unrestricted ink flow through pinch points 80 to vaporization chamber 74. Pinch points 80 separate plenum 78 from vaporization chamber 74 by a distance $W_{80}$ of approximately 17.5 $\mu$m. The tips of pinch points 80 form an opening with a width $W_{open}$ of approximately 20 $\mu$m. Vaporization chamber 74 is approximately 45 $\mu$m by 45 $\mu$m.

The center of orifice 84 is a distance $D_{84}$ of approximately 87.5 $\mu$m from the edge of barrier layer 62. Further, each orifice 84 is separated from the next orifice 84 by a distance of approximately 85 $\mu$m.

FIG. 10 is a side elevational view cross-section taken along line C—C in FIG. 9 showing tape 48, barrier layer 62 and a portion of substrate 60. As shown in FIG. 10, grooves 64 in tape 48 have a triangular cross-section with a height $H_{64}$, which is approximately 25 $\mu$m to 45 $\mu$m, nominally 45 $\mu$m.

Because the printhead architecture, as shown in FIGS. 9 and 10, is relatively simple, the shelf length, i.e., the distance from the resistor 72 to the edge of barrier layer 62, is smaller than found in conventional inkjet printers. A small shelf length, which is approximately the same as $D_{84}$ as shown in FIG. 9, permits the use of a smaller substrate 60. By making the substrate 60 smaller, more substrates can be formed per wafer, thus lowering the material cost per substrate.

Moreover, the present invention makes the proper operation of the printhead less sensitive to the process of cutting the substrates from the wafer than for a conventional printhead. In a conventional printhead, where channels extend from the vaporization chambers to the end of the barrier, the distance between the edge of the barrier and the edge of the substrate has a large effect on the refill rate because the ink must travel that distance before entering the channels in the barrier. Thus, in a conventional printhead, the process of cutting the substrate from the wafer must be extremely accurate to ensure the correct distance between the edge of the barrier and the edge of the substrate. However, in accordance with an embodiment of the present invention, plenum 78 is separated form the edge of barrier layer 62 by a distance $D_{SEP}$, and is in communication with the ink reservoir via grooves 64, which extend beyond the edge of barrier layer 62 by a distance $EXT_{64}$. Consequently, the distance that ink must flow through grooves 64 to gain access to plenum 78 is always $D_{SEP}$ regardless of the location of the edge of the substrate. Consequently, the accuracy of the substrate cutting processes is not as important for proper operation, i.e., refill rate, of a printhead that has a configuration in accordance with an embodiment of the present invention.

Further, because each vaporization chamber 74 receives ink via independently associated grooves 64, the vaporization chambers 74 are isolated from each other. Consequently, cross talk between vaporization chambers 74 is virtually eliminated.

Moreover, by avoiding the use of channels in barrier layer 62 between the ink reservoir 38 (shown in FIG. 2) and the plenum 78 in the present invention, there is additional material to which tape 48 can adhere. The additional barrier layer 62 material to which tape 48 can adhere advantageously reduces undesirable delamination, as well as unintended dimpling of the tape 48 when tape 48 is affixed to barrier layer 62.

Figure 11:
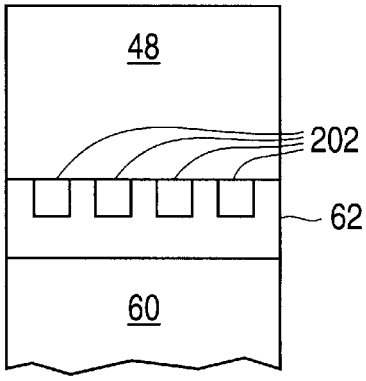
FIGS. 11 and 12 are side elevational views showing alternative embodiments of the grooves disposed between the tape and the barrier layer.

FIG. 11 is a side elevational view similar to that shown in FIG. 10, like designated elements being the same. FIG. 1, however, shows an alternative embodiment of grooves disposed between tape 48 and barrier layer 62 such that ink is permitted to flow between tape 48 and barrier layer 62. As shown in FIG. 11, grooves 202 are located in barrier layer 62 thereby replacing grooves 64 (shown in FIG. 10) in tape 48. Grooves 202 are formed using conventional lithographic techniques, and may have a rectangular cross-section or any other geometrical cross-section permitted by the lithographic process. Grooves 202 extend from the edge of the barrier layer 62 to the plenum 78 and should have a dimension adequate to permit an unrestricted ink supply to plenum 78.

Figure 12:
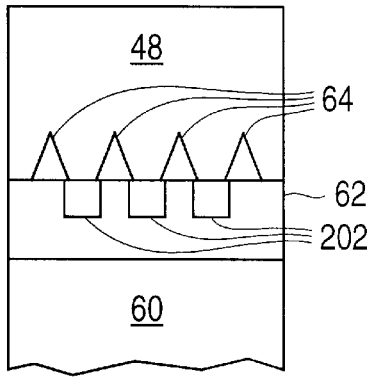

FIG. 12 is a side elevational view similar to that shown in FIGS. 10 and 11, like designated elements being the same. As shown in FIG. 12, grooves 64 in tape 48 may be used in combination with grooves 202 in barrier layer 62. This configuration advantageously increases ink flow into plenum 78, while maintaining the same particle exclusion properties.

It should also be understood that while plenums 78 and vaporization chambers 74 are described in the present disclosure as being formed within barrier layer 62, one or both of plenums 78 and vaporization chambers 74 may be partially or completely formed within tape 48.

Figure 13:
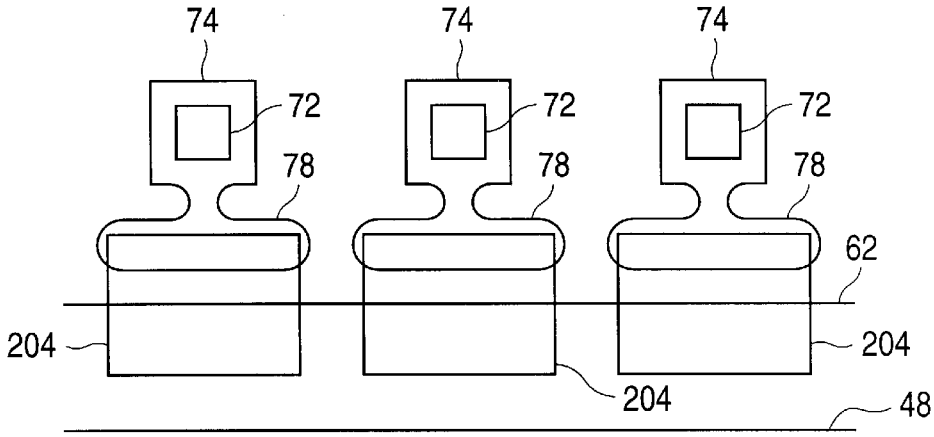
FIGS. 13 through 16 are top down plan views of various exemplary embodiments.

FIGS. 13 through 16 are top down plan views of various exemplary embodiments showing the edge of tape 48 and the edge of barrier layer 62, where tape 48 is overlying barrier layer 62. As shown in FIG. 13, instead of a plurality of grooves 64, a single wide groove 204 may be used to supply ink to a corresponding plenum 78. Single groove 204 has a cross-sectional dimension adequate to permit an unrestricted ink supply to plenum 78. The height of single groove 204 is sufficiently low, e.g., 5 $\mu$m to 20 $\mu$m, to maintain the desired particle exclusion properties.

Figure 14:
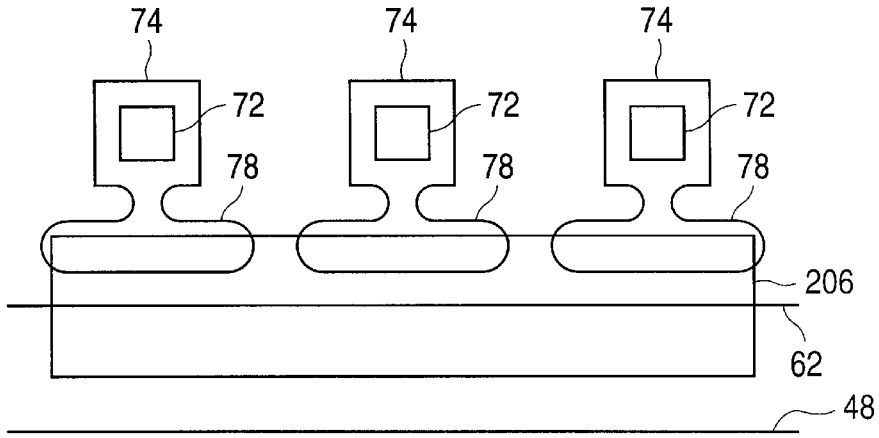

FIG. 14 illustrates the use of a single groove 206 to supply ink to a plurality of plenums 78. Groove 206 may be used to supply ink to a discrete number of plenums 78, e.g., three, as shown in FIG. 14, or alternatively one groove 206 may be used to supply ink to all the plenums 78 located on one side of the substrate.

Figure 15:
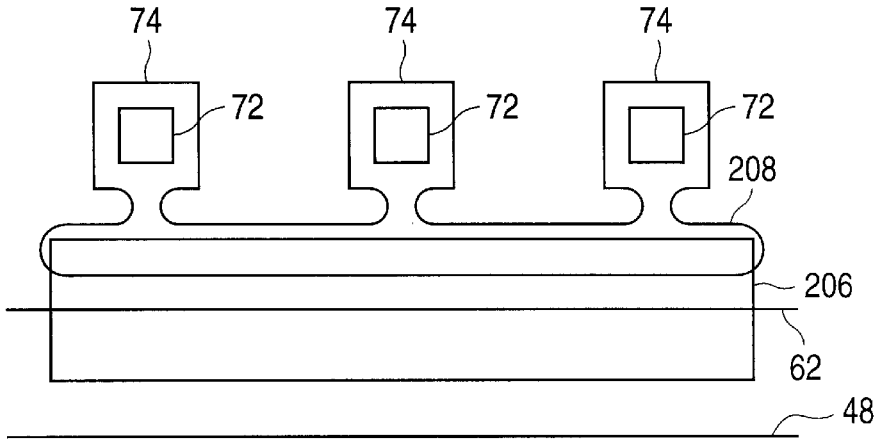

FIG. 15 illustrates another embodiment using groove 206 to supply ink to a single plenum 208 associated with a number of vaporization chambers 74. Plenum 208 may be used to supply ink to a discrete number of vaporization chambers 74, e.g., three, as shown in FIG. 15, or alternatively plenum 208 may be used to supply ink to all the vaporization chambers 74 located on one side of the substrate.

Figure 16:
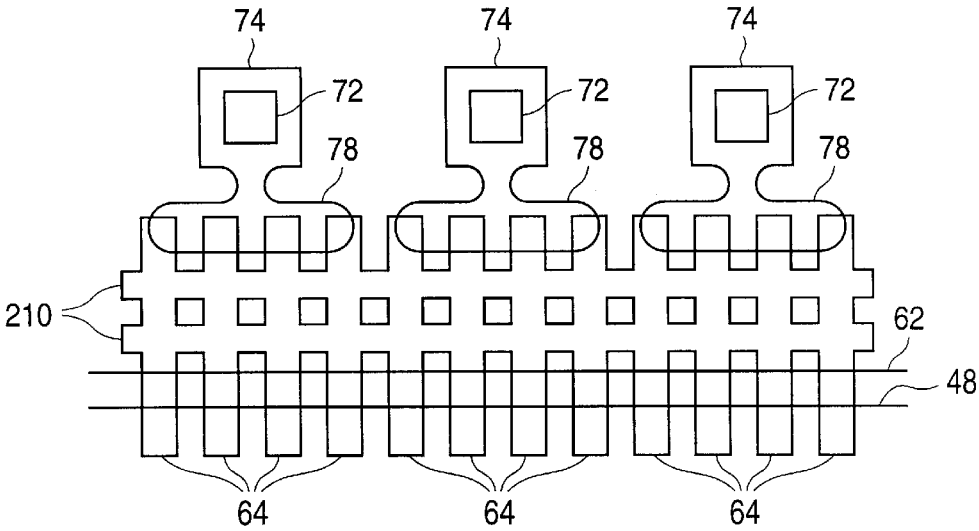

FIG. 16 illustrates an embodiment in which grooves 64 in tape 48 are used in conjunction with cross grooves 210. Cross grooves 210 are generated in the same manner as grooves 64. Any desired number of cross grooves 210 may be used.

Figure 17:
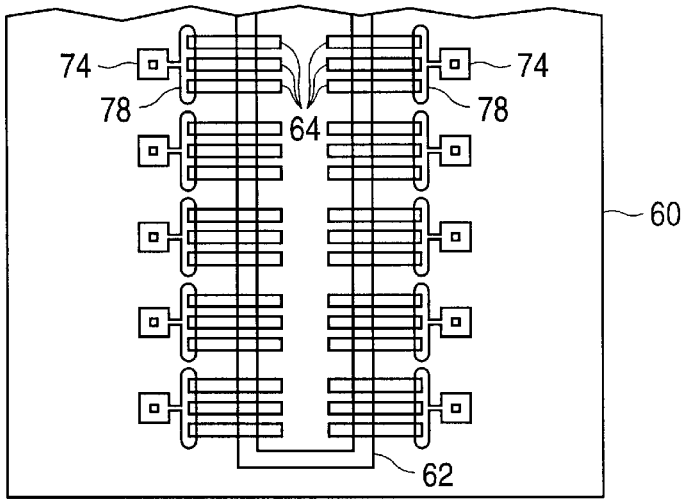
FIG. 17 illustrates an embodiment of the printhead architecture using a center feed configuration.

FIG. 17 illustrates an embodiment of the printhead architecture, showing a portion of substrate 60 using a center feed configuration. As shown in FIG. 17, substrate 60 has a center feed hole 61 through which ink from ink reservoir 38 (shown in FIG. 2) flows to grooves 64. Grooves 64 are disposed in barrier layer 62, which is not shown in FIG. 17 for the sake of clarity. Plenums 74 and vaporization chambers 78 are located near the center feed hole 61 such that ink flowing through the center feed hole 61 flows through grooves 64 and into plenums 74. Thus, the printhead architecture may have a center feed configuration. Center feed hole 61 may be mechanically or chemically formed using conventional etching methods.

Of course, as described in FIGS. 11 and 12, the embodiments illustrated in FIGS. 13–17 may also be produced with the grooves in the barrier layer 62. In addition, if desired, the embodiments shown in FIGS. 13–17 may be used alone or in combination.

Figure 18:
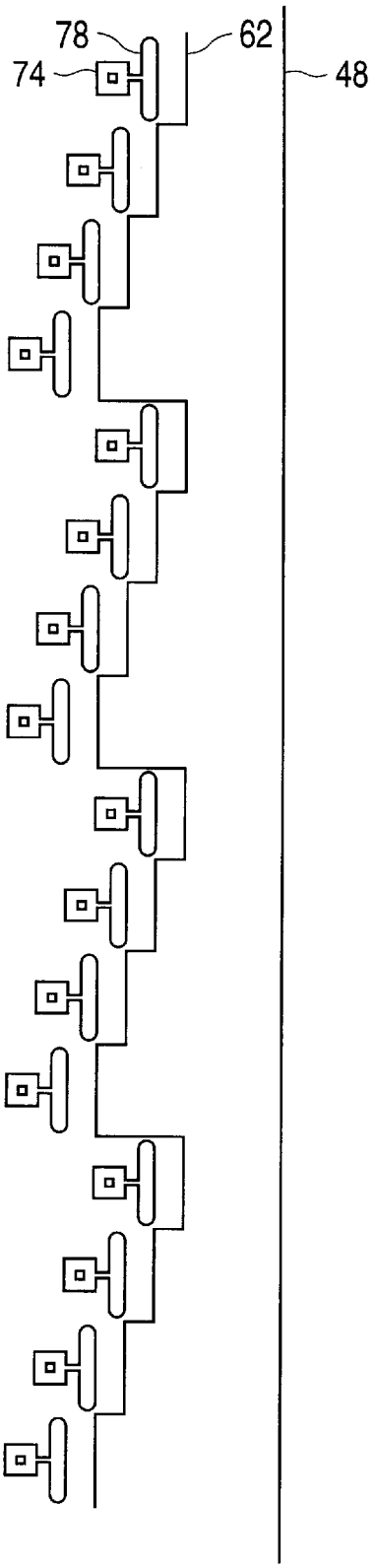
FIGS. 18 and 19 show top plan views of a stagger relation and a straight relation, respectively, between a group of vaporization chambers with plenums and the edge of the barrier layer.
Figure 19:
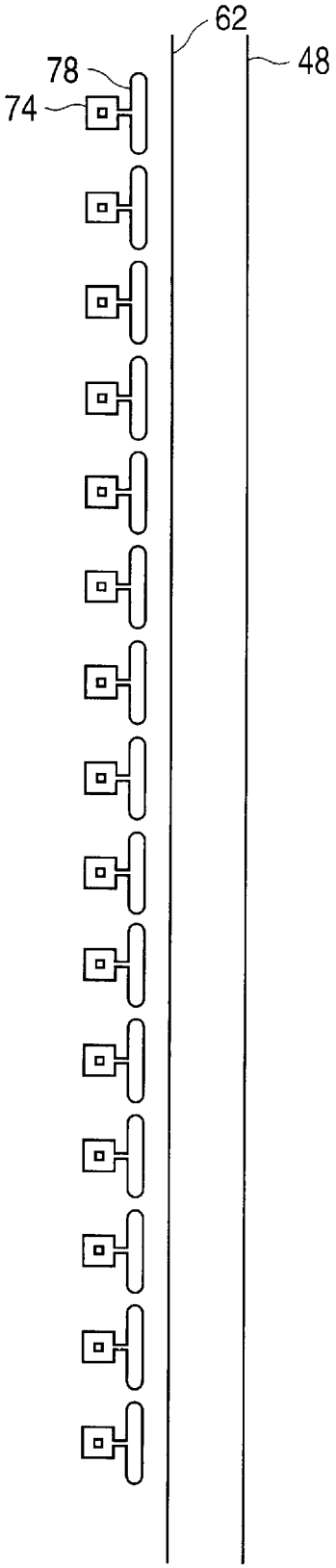

FIGS. 18 and 19 show top plan views of the relation between a group of the printhead architecture as shown as vaporization chambers 74 with plenums 78 and the edge of barrier layer 62. FIG. 18 shows the printhead architecture in a stagger configuration. The ink is supplied to plenums 78 and vaporization chambers 74 via grooves 64 (shown in FIG. 9), which is in constant contact with the ink reservoir 38 (shown in FIG. 2). As shown in FIG. 18, the edge of barrier layer 62 is staggered correspondingly with the plenums 78. Thus, the distance from the plenums 78 to the edge of barrier layer 62 will not affect the frequency with which the vaporization chamber 74 can be refilled. With a stagger configuration, the resistors in each vaporization chamber 74 are addressed in a staggered manner. Thus, as the printhead scans across the paper, a appropriately delayed address signal to the resistors is used to cause the dots produced by from each vaporization chamber 74 to align with each other vertically to create a vertical line. Thus, only a portion of the resistors must be fired simultaneously to generate a straight vertical line, which advantageously limits power demands.

FIG. 19 shows printhead architecture in a straight configuration, in which the plenums 78 are equal distant from the edge of barrier layer 62. A cartridge containing a printhead having the architecture shown FIG. 19 is installed in a printer in a slanted orientation. Thus, the vaporization chambers 74 will be at an angle from vertical when installed in a printer, such that each vaporization chamber 74 is slightly offset relative to another chamber. The resistors in each vaporization chamber 74 are sequentially addressed. Thus, as the printhead scans across the paper, a delayed address signal to each offset resistor can then be used to cause the dots produced by from each vaporization chamber 74 to align with each other vertically to create a vertical line, which advantageously limits power demands.

Figure 20:
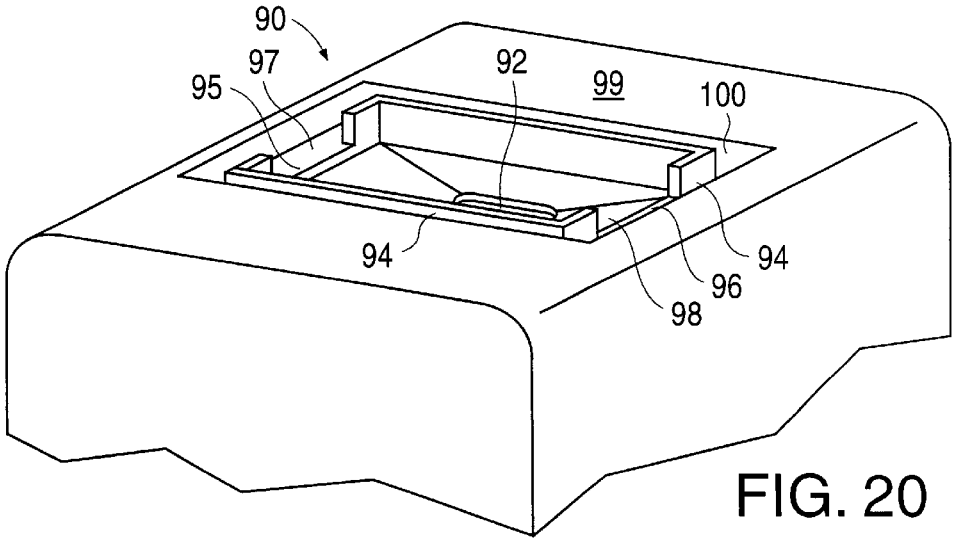
FIG. 20 shows the print cartridge of FIG. 2 with the printhead assembly removed to reveal the headland pattern used in providing a seal between the printhead assembly and the printhead body.

FIG. 20 shows the print cartridge 18 of FIG. 2 with the printhead assembly 42 removed to reveal the headland pattern 90 used in providing a seal between the printhead assembly 42 and the printhead body. The headland characteristics are exaggerated in FIG. 20 for clarity. Also shown in FIG. 20 is a central slot 92 in the print cartridge 18 for allowing ink from the ink reservoir 38 to flow to the back surface of the printhead assembly 42.

The headland pattern 90 formed on the print cartridge 18 is configured so that a bead of epoxy adhesive dispensed on the inner raised walls 94 and across the wall openings 95 and 96 (so as to circumscribe the substrate when the printhead assembly 42 is in place) will form an ink seal between the body of the print cartridge 18 and the back of the printhead assembly 42 when the printhead assembly 42 is pressed into place against the headland pattern 90. Other adhesives that may be used include hot-melt, silicone, UV curable adhesive, and mixtures thereof. Further, a patterned adhesive film may be positioned on the headland 90, as opposed to dispensing a bead of adhesive.

When the printhead assembly 42 of FIG. 4 is properly positioned and pressed down on the headland pattern 90 in FIG. 20 after the adhesive is dispensed, the two short ends of the substrate 60 will be supported by the surface portions 97 and 98 within the wall openings 95 and 96. The configuration of the headland pattern 90 is such that, when the substrate 60 is supported by the surface portions 97 and 98, the back surface of the tape 48 will be slightly above the top of the raised walls 94 and approximately flush with the flat top surface 99 of the print cartridge 18. As the printhead assembly 42 is pressed down onto the headland 90, the adhesive is squished down. From the top of the inner raised walls 94, the adhesive overspills into the gutter between the inner raised walls 94 and the outer raised wall 100 and overspills somewhat toward the slot 92. From the wall openings 95 and 96, the adhesive squishes inwardly in the direction of slot 92 and squishes outwardly toward the outer raised wall 100, which blocks further outward displacement of the adhesive. The outward displacement of the adhesive not only serves as an ink seal, but encapsulates the conductive traces in the vicinity of the headland 90 from underneath to protect the traces from ink.

This seal formed by the adhesive circumscribing the substrate 60 will allow ink to flow from slot 92 around the sides of the substrate 60 and into the vaporization chambers 74 via grooves 64, but will prevent ink from seeping out from under the printhead assembly 42. Thus, this adhesive seal provides a strong mechanical coupling of the printhead assembly 42 to the print cartridge 18, provides a fluid seal, and provides trace encapsulation. The adhesive seal is also easy to cure, and permits detection of leaks between the print cartridge body and the printhead, since the sealant line is readily observable.

Figure 21:
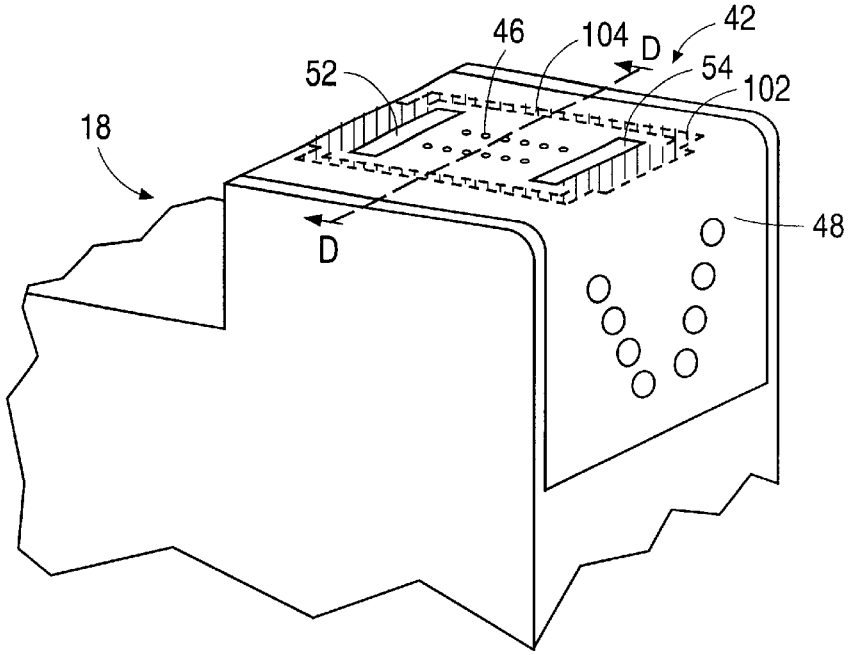
FIG. 21 shows a portion of the completed print cartridge illustrating, by cross-hatching, the location of the underlying adhesive which forms the seal between the printhead assembly and the body of the print cartridge.

FIG. 21 shows a portion of the completed print cartridge 18 illustrating, by cross-hatching, the location of the underlying adhesive that forms the seal between the printhead assembly 42 and the body of the print cartridge 18. In FIG. 21 the adhesive is located generally between the dashed lines surrounding the array of orifices 46, where the outer dashed line 102 is slightly within the boundaries of the outer raised wall 100 in FIG. 20, and the inner dashed line 104 is slightly within the boundaries of the inner raised walls 94 in FIG. 20. The adhesive is also shown being squished through the wall openings 95 and 96 (FIG. 20) to encapsulate the traces leading to electrodes on the substrate.

Figure 22:
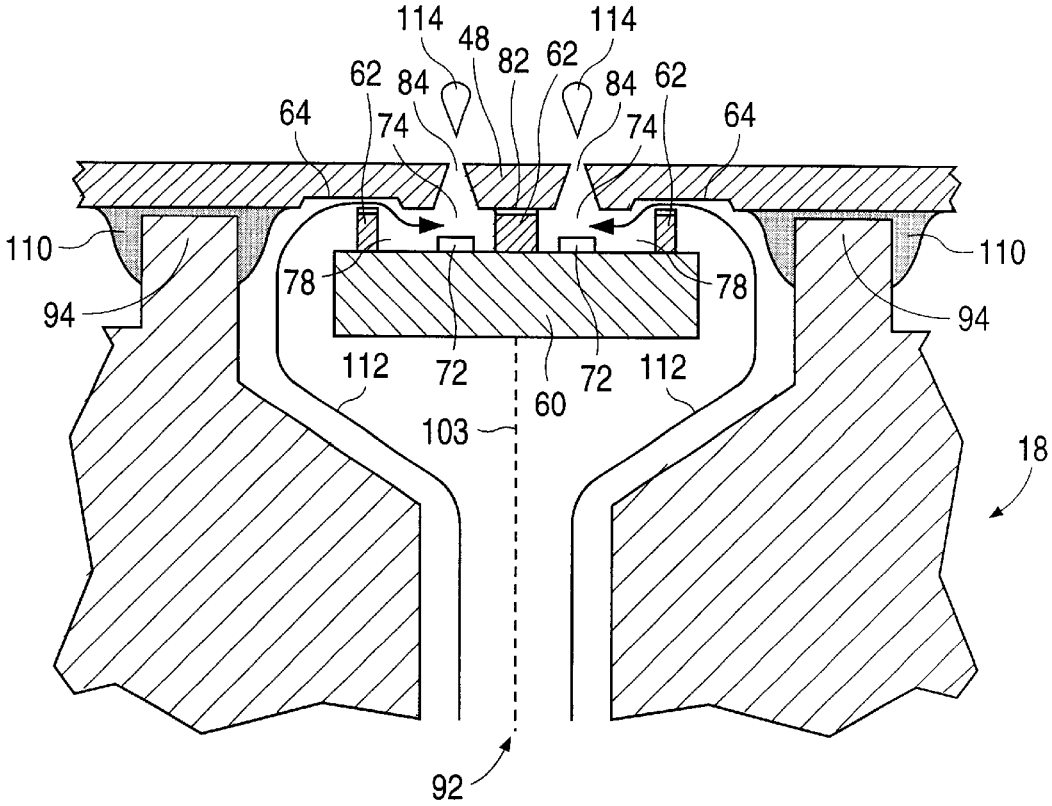
FIG. 22 shows a side elevational view cross-section taken along line C—C in FIG. 21.

Shown in FIG. 22 is a side elevational view cross-section taken along line D—D in FIG. 21 showing a portion of the adhesive seal 110 surrounding the substrate 60 and showing the substrate 60 being adhesively secured to a central portion of the tape 48 by the thin adhesive layer 82 on the top surface of the barrier layer 62 containing the plenums 78 and vaporization chambers 74 (pinch points 80 are not shown in this cross-sectional view). A portion of the plastic body of the printhead cartridge 18 including raised walls 94 shown in FIG. 20, is also shown. Thin film resistors 72 are shown within the vaporization chambers 74.

FIG. 22 also illustrates how ink 112 from the ink reservoir 38 (shown in FIG. 2) flows through the central slot 92 formed in the print cartridge 18 and flows around the edges of the substrate 60, through grooves 64 in tape 48, and into the plenums 78 and vaporization chambers 74. When the resistors 72 are energized, the ink within the vaporization chambers 74 are ejected through orifices 84, as illustrated by the emitted drops of ink 114.

In another embodiment, the ink reservoir contains two separate ink sources, each containing a different color of ink. In this alternative embodiment the central slot 92 in FIG. 22 is bisected, as shown by the dashed line 103, so that each side of the central slot 92 communicates with a separate ink source. Therefore, the left linear array of vaporization chambers can be made to eject one color of ink, while the right linear array of vaporization chambers can be made to eject a different color of ink. This concept can even be used to create a four color printhead, where a different ink reservoir feeds ink to grooves along each of the four sides of the substrate. Thus, instead of the two-edge feed design discussed above, a four-edge design would be used, preferably using a square substrate for symmetry.

Figure 23:
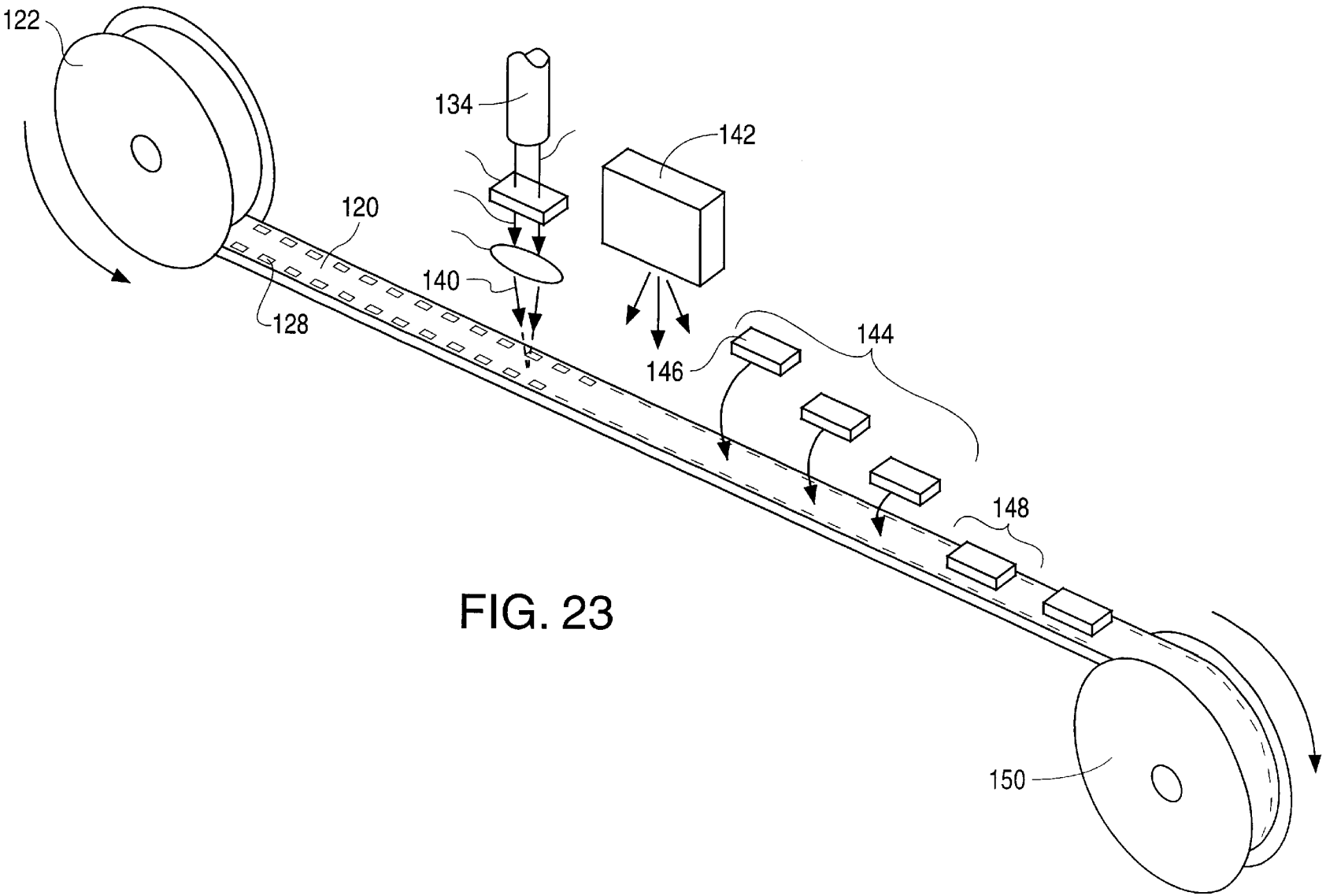
FIG. 23 illustrates one method for forming the printhead assembly shown in FIG. 4.

FIG. 23 illustrates one method for forming the printhead assembly 42 in FIG. 4.

The starting material is a Kapton TM or Upilex TM-type polymer tape 120, although the tape 120 can be any suitable polymer film that is acceptable for use in the below-described procedure. Some such films may comprise teflon, polyimide, polymethylmethacrylate, polycarbonate, polyester, polyamide polyethyleneterephthaiate or mixtures thereof.

The tape 120 is typically provided in long strips on a reel 122. Sprocket holes 128 along the sides of the tape 120 are used to accurately and securely transport the tape 120. Alternately, the sprocket holes 128 may be omitted and the tape may be transported with other types of fixtures.

In the preferred embodiment, the tape 120 is already provided with conductive copper traces 66, such as shown in FIG. 4, formed thereon using conventional metal deposition and lithographic processes. The particular pattern of conductive traces depends on the manner in which it is desired to distribute electrical signals to the electrodes formed on silicon dies, which are subsequently mounted on the tape 120.

In the preferred process, the tape 120 is transported to a laser processing chamber and laser-ablated in a pattern defined by one or more masks 130 using laser radiation 132, such as the generated by an Excimer laser 134 of the $F_2$, ArF, KrCJ, KrF, or XeCl type. The masked laser radiation is designated by arrows 136.

In a preferred embodiment, such masks 130 define all of the ablated features for an extended area of the tape 120, for example encompassing multiple orifices 84 and multiple grooves 64 (shown in FIG. 7). Alternatively, patterns such as the orifice pattern and the groove patterns, or other patterns may be placed side by side on a common mask substrate that is substantially larger than the laser beam. Then such patterns may be moved sequentially into the beam. The masking material used in such masks will preferably be highly reflecting at the laser wavelength, consisting of, for example, a multilayer dielectric or a metal such as aluminum or chrome.

Because grooves 64 are only partially ablated through tape 120, the groove design in mask 130 is a half tone. Thus, the masked laser radiation 136 that produces grooves 64 will have a fraction of the intensity of the masked laser radiation 126 that produces orifices 84. Consequently, orifices 84 will be ablated completely through tape 120 and grooves 64 will be only partially ablated through tape 120. Generating a half tone mask to laser ablate a pattern a desired depth into a substrate is well known in the art.

Alternatively, orifices 84 and grooves 64 may be ablated into tape 120 through a single or multiple masks 130 at different laser energy levels. Thus, after ablating one of the features into tape 120, the energy level of the laser 134 would be appropriately adjusted to generate the desired pattern at the required depth in tape 120. In another embodiment, grooves 64 are partially ablated into tape 48 using thin slits in mask 130. The energy levels of laser 134 is held constant and the width of the slits in mask 130 is used to control the depth of the ablation, which produces a groove with a triangular cross-section. In yet another embodiment, the number of laser pulses per unit area may be reduced to ablate grooves 64 into tape 48 to the desired depth. Of course, if desired, any combination of these processes or alternative processes may be used to produce the grooves between tape 48 and barrier layer 62.

In one embodiment, a separate mask 130 defines the pattern of windows 52 and 54 shown in FIGS. 2 and 3; however, in the preferred embodiment, the windows 52 and 54 are formed using conventional lithographic methods prior to the tape 120 being subjected to the processes shown in FIG. 23.

The laser system for this process generally includes beam delivery optics, alignment optics, a high precision and high speed mask shuttle system, and a processing chamber including a mechanism for handling and positioning the tape 120. In the preferred embodiment, the laser system uses a projection mask configuration wherein a precision lens 138 interposed between the mask 130 and the tape 120 projects the Excimer laser light onto the tape 120 in the image of the pattern defined on the mask 130. The masked laser radiation exiting from lens 138 is represented by arrows 140.

Such a projection mask configuration is advantageous for high precision orifice dimensions, because the mask is physically remote from the nozzle member. Soot is naturally formed and ejected in the ablation process, traveling distances of about one centimeter from the nozzle member being ablated. If the mask were in contact with the nozzle member, or in proximity to it, soot buildup on the mask would tend to distort ablated features and reduce their dimensional accuracy. In the preferred embodiment, the projection lens is more than two centimeters from the nozzle member being ablated, thereby avoiding the buildup of any soot on it or on the mask.

Ablation is well known to produce features with tapered walls, tapered so that the diameter of an orifice is larger at the surface onto which the laser is incident, and smaller at the exit surface. The taper angle can be used to accurately ablate the grooves to the desired depth. The taper angle varies significantly with variations in the optical energy density incident on the nozzle member for energy densities less than about two joules per square centimeter. If the energy density was uncontrolled, the orifices and grooves produced would vary significantly in taper angle, resulting in substantial variations in exit orifice diameter and depth of the grooves. Such variations would produce deleterious variations in ejected ink drop volume and velocity and ink flow, thereby reducing print quality. In the preferred embodiment, the optical energy of the ablating laser beam is precisely monitored and controlled to achieve a consistent taper angle, and thereby a reproducible exit diameter. In addition to the print quality benefits resulting from the constant orifice exit diameter, a taper is beneficial to the operation of the orifices because the taper acts to increase the discharge speed and provide a more focused ejection of ink, as well as provide other advantages. The taper may be in the range of 5 to 15 degrees relative to the axis of the orifice. The preferred embodiment process described herein allows rapid and precise fabrication without a need to rock the laser beam relative to the nozzle member. It produces accurate exit diameters even though the laser beam is incident on the entrance surface rather than the exit surface of the nozzle member.

After the step of laser-ablation the polymer tape 120 is stepped, and the process is repeated. This is referred to as a step-and-repeat process. The total processing time required for forming a single pattern on the tape 120 may be on the order of a few seconds. As mentioned above, a single mask pattern may encompass an extended group of ablated features to reduce the processing time per nozzle member.

Laser ablation processes have distinct advantages-over other forms of laser drilling for the formation of precision orifices and grooves. In laser ablation, short pulses of intense ultraviolet light are absorbed in a thin surface layer of material within about 1 micrometer or less of the surface. Preferred pulse energies are greater than about 100 millijoules per square centimeter and pulse durations are shorter than about 1 microsecond. Under these conditions, the intense ultraviolet light photodissociates the chemical bonds in the material. Furthermore, the absorbed ultraviolet energy is concentrated in such a small volume of material that it rapidly heats the dissociated fragments and ejects them away from the surface of the material. Because these processes occur so quickly, there is no time for heat to propagate to the surrounding material. As a result, the surrounding region is not melted or otherwise damaged, and the perimeter of ablated features can replicate the shape of the incident optical beam with precision on the scale of about one micrometer.

Laser-ablation processes also have numerous advantages as compared to conventional lithographic electroforming processes for forming nozzle members for ink-jet printheads. For example, laser-ablation processes generally are less expensive and simpler than conventional lithographic electroforming processes. In addition, by using laser-ablations processes, polymer nozzle members can be fabricated in substantially larger sizes (i.e., having greater surface areas) and with nozzle geometries that are not practical with conventional electroforming processes. In particular, unique nozzle shapes can be produced by controlling exposure intensity or making multiple exposures with a laser beam being reoriented between each exposure. Examples of a variety of nozzle shapes are described in copending application Ser. No. 07/658,726, entitled "A Process of Photo-Ablating at Least One Stepped Opening Extending Through a Polymer Material, and a Nozzle Plate Having Stepped Openings" assigned to the present assignee and incorporated herein by reference. Also, precise nozzle geometries can be formed without process controls as strict as those required for electroforming processes.

Another advantage of forming nozzle members by laser-ablating a polymer material is that the orifices or nozzles can be easily fabricated with various ratios of nozzle length (L) to nozzle diameter (D). In the preferred embodiment, the L/D ratio exceeds unity.

In use, laser-ablated polymer nozzle members for inkjet printers have characteristics that are superior to conventional electroformed orifice plates. For example, laser-ablated polymer nozzle members are highly resistant to corrosion by water-based printing inks and are generally hydrophobic. Further, laser-ablated polymer nozzle members have a relatively low elastic modulus, so built-in stress between the nozzle member and an underlying substrate or barrier layer has less of a tendency to cause nozzle member-to-barrier layer delamination. Still further, laser-ablated polymer nozzle members can be readily fixed to, or formed with, a polymer substrate.

Although an Excimer laser is used in the preferred embodiments, other ultraviolet light sources with substantially the same optical wavelength and energy density may be used to accomplish the ablation process. Preferably, the wavelength of such an ultraviolet light source will lie in the 150 nm to 400 nm range to allow high absorption in the tape to be ablated. Furthermore, the energy density should be greater than about 100 millijoules per square centimeter with a pulse length shorter than about 1 microsecond to achieve rapid ejection of ablated material with essentially no heating of the surrounding remaining material.

As will be understood by those of ordinary skill in the art, numerous other processes for forming a pattern on the tape 120 may also be used. Other such processes include chemical etching, stamping, reactive ion etching, ion beam milling, and molding or casting on a photodefined pattern.

A next step in the process is a cleaning step wherein the laser ablated portion of the tape 120 is positioned under a cleaning station 142. At the cleaning station 142, debris from the laser ablation is removed according to standard industry practice.

The tape 120 is then stepped to the next station, which is an optical alignment station 144 incorporated in a conventional automatic TAB bonder, such as an inner lead bonder commercially available from Shinkawa Corporation, model number 1L-20. The bonder is preprogrammed with an alignment (target) pattern on the nozzle member, created in the same manner and/or step as use to created the orifices, and a target pattern on the substrate, created in the same manner and/or step used to create the resistors. In the preferred embodiment, the nozzle member material is semi-transparent so that the target pattern on the substrate may be viewed through the nozzle member. The bonder then automatically positions the silicon dies 146 with respect to the nozzle members so as to align the two target patterns. Such an alignment feature exists in the Shinkawa TAB bonder. This automatic alignment of the nozzle member target pattern with the substrate target pattern not only precisely aligns the orifices with the resistor but also inherently aligns the electrodes on the dies 144 with the ends of the conductive traces formed in the tape 120, since the traces and the orifices are aligned in the tape 120, and the substrate electrodes and the heating resistors are aligned on the substrate. Therefore, all patterns on the tape 120 and on the silicon dies 146 will be aligned with respect to one another once the two target patterns are aligned. Because the grooves 64 are matched with corresponding orifices 84, the grooves will be automatically aligned with the plenums 78.

Thus, the alignment of the silicon dies 146 with respect to the tape 120 is performed automatically using only commercially available equipment. By integrating the conductive traces with the nozzle member, such an alignment feature is possible. Such integration not only reduces the assembly cost of the printhead but reduces the printhead material cost as well.

The automatic TAB bonder then uses a gang bonding method to press the ends of the conductive traces down onto the associated substrate electrodes through the windows formed in the tape 120. The bonder then applies heat, such as by using thermocompression bonding, to weld the ends of the traces to the associated electrodes. A side view of one embodiment of the resulting structure is shown in FIG. 5. Other types of bonding can also be use, such as ultrasonic bonding conductive epoxy, solder paste, or other well-known means.

The tape 120 is then stepped to a heat and pressure station 148. As previously discussed with respect to FIG. 6, an adhesive layer 82, if used, exists on the top surface of the barrier layer 62 formed on the silicon substrate. After the above-described bonding step, the silicon dies 146 are then pressed down against the tape 120, and heat is applied to cure the adhesive layer 82 and physically bond the dies 146 to the tape 120.

Thereafter the tape 120 steps and is optionally taken up on the take-up reel 150. The tape 120 may then later be cut to separate the individual printhead assemblies from one another.

The resulting printhead assembly is then positioned on the print cartridge 18, and the previously described adhesive seal 110 in FIG. 22 is formed to firmly secure the nozzle member to the print cartridge, provide an ink-proof seal around the substrate between the nozzle member and the ink reservoir, and encapsulate the traces in the vicinity of the headland so as to isolate the traces from the ink.

Peripheral points on the flexible printhead assembly are then secured to the plastic print cartridge 18 by a conventional melt-through type bonding process to cause the polymer tape 48 to remain relatively flush with the surface of the print cartridge 18, as shown in FIG. 2.

The foregoing has described the principles, preferred embodiments and modes of operation of the present invention. However, the invention should not be construed as being limited to the particular embodiments discussed. As an example, the above-described inventions can be used in conjunction with inkjet printers that are not of the thermal type, as well as inkjet printers that are of the thermal type. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A printing apparatus comprising: a printhead comprising:

a substrate having a top surface and an opposing bottom surface, and a first edge;

a nozzle member having a plurality of ink orifices formed therein, said nozzle member being positioned to overlie said top surface of said substrate;

at least one groove disposed between said nozzle member and said substrate, said at least one groove being associated with said plurality of ink orifices, said at least one groove having a first end communicating with an ink reservoir;

a plurality of ink ejection elements formed on said top surface of said substrate, each of said ink ejection elements being located proximate to an associated one of said orifices for expelling a portion of ink from said associated orifice;

fluid channels communicating with a second end of said at least one groove and leading to each of said orifices and said ink ejection elements, said fluid channels comprise at least one plenum and a plurality of ink ejection chambers, said at least one plenum communicating between a second end of said at least one groove and said ink ejection chambers, each of said ink ejection chambers being associated with an ink orifice and an ink ejection element; and wherein said at least one plenum is in fluid communication with said ink reservoir solely through said at least one groove, and said fluid channels allow ink to flow from said second end of said at least one groove to said ink ejection chambers.

2. The printing apparatus of claim 1, wherein said fluid channels comprise a plenum associated with each ink ejection chamber.

3. The printing apparatus of claim 2 wherein there are a plurality of grooves associated with each plenum associated with each ink ejection chamber.

4. The printing apparatus of claim 3 wherein there are a four grooves associated with each plenum associated with each ink ejection chamber.

5. The printing apparatus of claim 1, wherein said at least one groove is formed in said nozzle member.

6. The printing apparatus of claim 5 wherein said substrate also has a second edge, said at least one groove is in communication with said ink reservoir by extending over said first edge of said substrate, a second at least one groove formed in said nozzle members, said second at least one groove communicates with said ink reservoir by extending over said second edge of said substrate so as to deliver ink from said ink reservoir to a second at least one plenum.

7. The printing apparatus of claim 1 wherein there are a plurality of grooves associated with said at least one plenum.

8. The printing apparatus of claim 1, each groove having a cross sectional dimension and each fluid channel having a cross sectional dimension, wherein the cross sectional dimension of each groove is less than the cross sectional dimension of said fluid channels.

9. The printing apparatus of claim 1 wherein said fluid channels are formed in a barrier layer between said substrate and said nozzle member.

10. The printing apparatus of claim 9 wherein said barrier layer is separate from said nozzle member and is adhered to a back surface of said nozzle member.

11. The printing apparatus of claim 1 further comprising a print cartridge body for housing said printhead.

12. The printing apparatus of claim 1 further comprising said ink reservoir.

13. The printing apparatus of claim 12 further comprising a supply of ink within said ink reservoir.

14. The printing apparatus of claim 1, further comprising said ink reservoir, wherein said ink reservoir contains two or more colors of ink, said apparatus further comprising:

a first set of plurality of grooves and first associated fluid channels leading to selected ones of said orifices for communicating with a portion of said ink reservoir containing a first color of ink, said first set of plurality of grooves allows said first color of ink to flow into said first associated fluid channels and proximate to said selected ones of said orifices; and a second set of plurality of grooves and second associated fluid channels leading to other selected ones of said orifices for communicating with a portion of said ink reservoir containing a second color of ink, said second set of plurality of grooves allows said second color of ink to flow into said second associated fluid channels and proximate to said other selected ones of said orifices.

15. A printing system, comprising:

a substrate having a top surface and an opposing bottom surface, and having a first edge;

an ink reservoir;

a nozzle member having a plurality of ink orifices formed therein, said nozzle member being positioned to overlie said top surface of said substrate;

at least one groove associated with each of said plurality of ink orifices, said at least one groove having a first end and a second end, said first end of said at least one groove in direct communication with said ink reservoir;

a plurality of ink ejection elements formed on said top surface of said substrate, each of said ink ejection elements being located proximate to an associated one of said orifices for expelling a portion of ink from said associated orifice;

a plurality of ink ejection chambers, each ink ejection chamber associated with an ink orifice and an ink ejection element; and at least one plenum associated with and in communication with said ink ejection chambers and said second end of said at least one groove, said at least one plenum is in communication with said ink reservoir solely through said at least one groove, wherein ink flows from said ink reservoir directly into said at least one groove and into said at least one plenum, said ink flows from said at least one plenum into said ink ejection chambers so as to be proximate to said orifices and said ink ejection elements.

16. The printing system of claim 15, wherein at least one plenum and said plurality of ink ejection chambers are formed in a barrier layer between said substrate and said nozzle member.

17. The printing system of claim 16, wherein at least one groove is formed in said nozzle member.

18. The printing system of claim 17 wherein said substrate also has a second edge, said at least one groove is in communication with said ink reservoir by extending over said first edge of said substrate, a second at least one groove formed in said nozzle members, said second at least one groove communicates with said ink reservoir by extending over said second edge of said substrate so as to deliver ink from said ink reservoir to a second at least one plenum.

19. The printing system of claim 15, wherein there is one plenum associated with each ink ejection chamber and each plenum is associated with a distinct at least one groove.

20. The printing system of claim 19, wherein there are four grooves associated with each plenum.

21. The printing system of claim 15 further comprising a plurality of flow restrictors located between each ink ejection chamber and said at least one plenum.

22. The printing system of claim 21, each groove having a cross sectional dimension and each flow restrictor having a cross sectional dimension, wherein the cross sectional dimension of each groove is less than the cross sectional dimension of said flow restrictors.

23. The printing system of claim 15 further comprising a supply of ink within said ink reservoir.

24. An ink delivery system for a printer having a print cartridge, said print cartridge having a printhead for ejecting droplets of ink, said printhead comprising:

a substrate having a top surface and an opposing bottom surface, and having a first edge;

a nozzle member having a plurality of ink orifices formed therein, said nozzle member being positioned to overlie said top surface of said substrate;

at least one groove associated with each of said plurality of ink orifices, said at least one groove having a first end and a second end, said first end of said at least one groove in direct fluid communication with an ink reservoir;

a plurality of ink ejection elements formed on said top surface of said substrate, each of said ink ejection elements being located proximate to an associated one of said orifices for ejecting a droplet of ink from said associated orifice;

a plurality of ink ejection chambers, each ink ejection chamber associated with an ink orifice and an ink ejection element; and at least one plenum associated with and in communication with said ink ejection chambers and said second end of said at least one groove, said at least one plenum is in communication with said ink reservoir solely through said at least one groove, wherein ink flows from said ink reservoir directly into said at least one groove and into said at least one plenum, said ink flows from said at least one plenum into said ink ejection chambers so as to be proximate to said orifices and said ink ejection elements;

said ink delivery system comprising:

an ink supply including said ink reservoir in fluid communication with said printhead, said ink supply being removably mountable on said printer;

ink contained in said ink reservoir.

25. The ink delivery system of claim 24, wherein said print cartridge is mounted on a carriage on said printer, said ink supply is removably mountable on said carriage on said printer.

26. The ink delivery system of claim 24, wherein said print cartridge is mounted on a carriage on said printer, said ink supply is removably mountable off said carriage on said printer, said ink reservoir is in fluid communication with said printhead by a flexible tubular member.

27. A method of printing comprising:

supplying ink from an ink reservoir through at least one groove in a nozzle member and into a plenum and an ink ejection chamber, said at least one groove receiving ink directly from said ink reservoir, said at least one plenum receiving ink solely through said at least one groove, each said ink ejection chamber substantially surrounding an ink ejection element formed on a top surface of a substrate, said nozzle member overlying said substrate; and energizing said ink ejection elements to expel a portion of ink in an associated one of said ink ejection chamber from an orifice in said nozzle member.

28. The method of printing of claim 27, further comprising providing an ink reservoir for supplying ink to said at least one groove in said nozzle member.

29. The method of printing of claim 27 further comprising replacing said ink reservoir when said ink reservoir is used with a new ink reservoir.

30. A method of printing comprising:

providing a supply of ink connected to a printhead;

supplying ink from said supply of ink to said printhead, said ink directly flowing from said supply of ink through at least one groove in a nozzle member and into a plenum and an ink ejection chamber, said at least one plenum receiving ink solely through said at least one groove, said ink ejection chamber substantially surrounding an ink ejection element formed on a top surface of a substrate, said nozzle member overlying said substrate; and energizing said ink ejection elements to expel a portion of ink in an associated one of said ink ejection chamber from an orifice in said nozzle member.

31. The method of printing of claim 30 further comprising replacing said supply of ink when said supply of ink is used with a new supply of ink.

32. A method of printing comprising: providing a supply of ink to be connected to a printhead, said printhead comprising at least one groove in a nozzle member, said at least one groove coupled to at least one plenum, said at least one plenum coupled to a plurality of ink ejection chambers, said at least one groove receiving ink directly from said supply of ink, said at least one plenum receiving ink solely through said at least one groove, each ink ejection chamber substantially surrounding an ink ejection element formed on a top surface of a substrate, said nozzle member overlying said substrate, said ink ejection elements expel a portion of ink in an associated one of said ink ejection chamber from an orifice in said nozzle member.

33. A printhead comprising:

a substrate having a top surface and an opposing bottom surface, and a first edge;

a plurality of ink ejection elements formed on said top surface of said substrate;

a plurality of ink ejection chambers, each of said ink ejection chambers surrounding an ink ejection element;

at least one plenum in fluid communication with a plurality of ink ejection chambers, said at least one plenum is closer to said first edge than said plurality of ink ejection chambers; and a nozzle member having a plurality of ink orifices formed therein, said nozzle member positioned to overlie said top surface of said substrate so that each ink orifice is located proximate to an ink ejection element within an ink ejection chamber, said nozzle member further having at least one groove extending from said at least one plenum to an ink reservoir in a direction approximately perpendicular to said first edge of said substrate.

34. The printhead of claim 33, wherein there are a plurality of grooves associated with said at least one plenum.

* * * * *

UNITED STATES PATENT AND TRADEMARK OFFICE

CERTIFICATE OF CORRECTION

PATENT NO. : 6,286,941 B1
DATED : September 11, 2001
INVENTOR(S) : Courian et al.

It is certified that error appears in the above-identified patent and that said Letters Patent is hereby corrected as shown below:

Column 17,
Line 29, delete "a".

Signed and Sealed this

Fifth Day of March, 2002

*Attest:*

*Attesting Officer*

JAMES E. ROGAN
*Director of the United States Patent and Trademark Office*